US007166000B2

(12) United States Patent
Pharney

(10) Patent No.: US 7,166,000 B2
(45) Date of Patent: Jan. 23, 2007

(54) COMMUNICATIONS CONNECTOR WITH LEADFRAME CONTACT WIRES THAT COMPENSATE DIFFERENTIAL TO COMMON MODE CROSSTALK

(75) Inventor: Julian Pharney, Indianapolis, IN (US)

(73) Assignee: CommScope Solutions Properties, LLC, Sparks, NV (US)

( * ) Notice: Subject to any disclaimer, the term of this patent is extended or adjusted under 35 U.S.C. 154(b) by 0 days.

(21) Appl. No.: 11/266,619

(22) Filed: Nov. 3, 2005

(65) Prior Publication Data

US 2006/0121793 A1 Jun. 8, 2006

(51) Int. Cl.
*H01R 24/00* (2006.01)

(52) U.S. Cl. ..... 439/676; 439/941

(58) Field of Classification Search ..... 439/676, 439/941, 79, 80

See application file for complete search history.

(56) References Cited

U.S. PATENT DOCUMENTS

| | | | |
|---|---|---|---|
| 5,186,647 | A | 2/1993 | Denkmann et al. |
| 5,299,956 | A | 4/1994 | Brownell et al. |
| 5,310,363 | A | 5/1994 | Brownell et al. |
| 5,326,284 | A | 7/1994 | Bohbot et al. |
| 5,328,390 | A | 7/1994 | Johnston et al. |
| 5,362,257 | A | 11/1994 | Neal et al. |
| 5,397,862 | A | 3/1995 | Bockelman et al. |
| 5,414,393 | A | 5/1995 | Rose et al. |
| 5,432,484 | A | 7/1995 | Klas et al. |
| 5,547,405 | A | 8/1996 | Pinney et al. |
| 5,571,035 | A | 11/1996 | Ferrill |
| 5,587,884 | A | 12/1996 | Raman |

(Continued)

FOREIGN PATENT DOCUMENTS

| | | |
|---|---|---|
| EP | 0 525 703 B1 | 2/1993 |

(Continued)

OTHER PUBLICATIONS

U.S. Appl. No. 10/845,104, filed May 14, 2004, Hashim.

*Primary Examiner*—Javaid H. Nasri
(74) *Attorney, Agent, or Firm*—Myers Bigel Sibley & Sajovec

(57) ABSTRACT

A communications jack includes: a dielectric mounting substrate; and a plurality of contact wires, each of the contact wires having a contact segment, a compensating segment in electrical connection with the contact segment, and a base in electrical connection with the compensating segment and mounted in the mounting substrate. The contact segments are generally transversely aligned and parallel with each other. The contact segments are arranged in pairs, with a first pair of contact segments being immediately adjacent each other, a second pair of contact segments being immediately adjacent each other and positioned one side of the first pair, a fourth pair of contact segments being immediately adjacent each other and positioned on an opposite side of the first pair, and a third pair of contact segments sandwiching the first pair, with one of the contact segments of the third pair being disposed between the first and second pairs, and the other of the contact segments being disposed between the first and fourth pairs. The compensating segments are configured and arranged such that differential to common mode crosstalk generated between the contact segments of the second and third pairs is opposite in polarity to the differential to common mode crosstalk generated between the compensating segments of the second and third pairs.

22 Claims, 12 Drawing Sheets

U.S. PATENT DOCUMENTS 5,618,185 A 4/1997 Aekins
5,779,503 A 7/1998 Tremblay et al.
5,911,602 A 6/1999 Vaden
5,915,989 A * 6/1999 Adriaenssens et al. ..... 439/404
5,921,818 A 7/1999 Larsen et al.
5,947,772 A 9/1999 Arnett et al.
5,961,354 A 10/1999 Hashim
5,967,853 A 10/1999 Hashim
5,971,813 A 10/1999 Kunz et al.
5,975,919 A 11/1999 Arnett et al.
5,989,071 A 11/1999 Larsen et al.
5,997,358 A 12/1999 Adriaenssens et al.
6,017,247 A 1/2000 Gwiazdowski
6,042,427 A * 3/2000 Adriaenssens et al. ..... 439/676
6,050,843 A * 4/2000 Adriaenssens et al. ..... 439/404
6,102,730 A 8/2000 Kjeidahl et al.
6,116,964 A 9/2000 Goodrich et al.
6,120,330 A 9/2000 Gwiazdowski
6,165,023 A 12/2000 Troutman et al.
6,170,154 B1 1/2001 Swarup
6,186,834 B1 2/2001 Arnett et al.
6,196,880 B1 3/2001 Goodrich et al.
6,238,235 B1 5/2001 Shavit et al.
6,270,358 B1 8/2001 Nozick
6,270,381 B1 8/2001 Adriaenssens
6,312,290 B1 11/2001 Belopolsky
6,350,158 B1 2/2002 Arnett et al.
6,353,540 B1 3/2002 Akiba et al.
6,356,162 B1 3/2002 Deflandre et al.
6,364,694 B1 4/2002 Lien
6,379,157 B1 4/2002 Curry et al.
6,379,198 B1 4/2002 Arnett et al.
6,407,542 B1 6/2002 Conte
6,428,362 B1 8/2002 Phommachanh
6,443,776 B2 9/2002 Reichle
6,443,777 B1 9/2002 McCurdy et al.
6,454,541 B1 9/2002 Ijiri et al.
6,464,529 B1 10/2002 Jensen et al.
6,464,541 B1 * 10/2002 Hashim et al. ..... 439/676
6,520,807 B2 2/2003 Winings
6,524,128 B2 2/2003 Marowsky et al.
6,530,810 B2 3/2003 Goodrich
6,558,204 B1 5/2003 Weatherley
6,558,207 B1 5/2003 Pepe et al.
6,561,838 B1 5/2003 Blichfeldt
6,571,187 B1 5/2003 Conte
6,592,395 B2 7/2003 Brown et al.
6,647,357 B1 11/2003 Conte
6,716,964 B1 4/2004 Chinnadurai
6,764,348 B2 7/2004 Han et al.
6,811,442 B1 11/2004 Lien et al.
6,962,503 B2 11/2005 Aekins
2001/0018287 A1 8/2001 Reichle
2001/0021608 A1 9/2001 Borolla et al.
2001/0048592 A1 12/2001 Nimomiya
2002/0088977 A1 7/2002 Mori et al.
2003/0129880 A1 7/2003 Arnett et al.
2004/0002267 A1 1/2004 Hatterscheid et al.
2006/0121788 A1 6/2006 Pharney
2006/0121789 A1 6/2006 Hashim
2006/0160428 A1 7/2006 Hashim

FOREIGN PATENT DOCUMENTS

EP 0 901 201 3/1999
EP 1 059 704 12/2000
EP 1 191 646 3/2002
EP 1 435 679 7/2004
WO WO 94/05092 3/1994
WO WO 99/53574 10/1999
WO WO 2003-019734 3/2003
WO WO 03/090322 10/2003

* cited by examiner

PRIOR ART

PRIOR ART

PRIOR ART

COMMUNICATIONS CONNECTOR WITH LEADFRAME CONTACT WIRES THAT COMPENSATE DIFFERENTIAL TO COMMON MODE CROSSTALK

FIELD OF THE INVENTION

The present invention relates generally to communication connectors and more particularly to near-end crosstalk (NEXT) and far-end crosstalk (FEXT) compensation in communication connectors.

BACKGROUND OF THE INVENTION

In an electrical communication system, it is sometimes advantageous to transmit information signals (video, audio, data) over a pair of wires (hereinafter "wire-pair" or "differential pair") rather than a single wire, wherein the transmitted signal comprises the voltage difference between the wires without regard to the absolute voltages present. Each wire in a wire-pair is susceptible to picking up electrical noise from sources such as lightning, automobile spark plugs, and radio stations, to name but a few. Because this type of noise is common to both wires within a pair, the differential signal is typically not disturbed. This is a fundamental reason for having closely spaced differential pairs.

Of greater concern, however, is the electrical noise that is picked up from nearby wires or pairs of wires that may extend in the same general direction for some distances and not cancel differentially on the victim pair. This is referred to as crosstalk. Particularly, in a communication system involving networked computers, channels are formed by cascading plugs, jacks and cable segments. In such channels, a modular plug often mates with a modular jack, and the proximities and routings of the electrical wires (conductors) and contacting structures within the jack and/or plug also can produce capacitive as well as inductive couplings that generate near-end crosstalk (NEXT) (i.e., the crosstalk measured at an input location corresponding to a source at the same location) as well as far-end crosstalk (FEXT) (i.e., the crosstalk measured at the output location corresponding to a source at the input location). Such crosstalks occur from closely-positioned wires over a short distance.

In all of the above situations, undesirable signals are present on the electrical conductors that can interfere with the information signal. When the same noise signal is added to each wire in the wire-pair, the voltage difference between the wires will remain about the same and "differential" cross-talk is not induced, while at the same time the average voltage on the two wires with respect to ground reference is elevated and "common mode" crosstalk is induced. On the other hand, when an opposite but equal noise signal is added to each wire in the wire pair, the voltage difference between the wires will be elevated and differential crosstalk is induced, while the average voltage on the two wires with respect to ground reference is not elevated and common mode crosstalk is not induced.

U.S. Pat. No. 5,997,358 to Adriaenssens et al. (hereinafter "the '358 patent") describes a two-stage scheme for compensating differential to differential NEXT for a plug-jack combination (the entire contents of the '358 patent are hereby incorporated herein by reference, as are U.S. Pat. Nos. 5,915,989; 6,042,427; 6,050,843; and 6,270,381). Connectors described in the '358 patent can reduce the internal NEXT (original crosstalk) between the electrical wire pairs of a modular plug by adding a fabricated or artificial crosstalk, usually in the jack, at one or more stages, thereby canceling or reducing the overall crosstalk for the plug-jack combination. The fabricated crosstalk is referred to herein as a compensation crosstalk. This idea can often be implemented by twice crossing the path of one of the differential pairs within the connector relative to the path of another differential pair within the connector, thereby providing two stages of NEXT compensation. Another common technique is to cross the conductors of pairs 1, 2 and 4 (as defined by 47 C.F.R. 68.502), leaving the conductors of pair 3 uncrossed (see, e.g., U.S. Pat. No. 6,464,541 to Hashim et al.), then to include a second compensation stage (e.g., in the form of capacitive compensation using one or more capacitors) on an attached printed wiring board. This scheme can be more efficient at reducing the NEXT than a scheme in which the compensation is added at a single stage, especially when the second and subsequent stages of compensation include a time delay that is selected to account for differences in phase between the offending and compensating crosstalk. This type of arrangement can include capacitive and/or inductive elements that introduce multi-stage crosstalk compensation, and is typically employed in jack lead frames and PWB structures within jacks. These configurations can allow connectors to meet "Category 6" performance standards set forth in ANSI/EIA/TIA 568, which are primary component standards for mated plugs and jacks for transmission frequencies up to 250 MHz.

Alien NEXT is the differential crosstalk that occurs between communication channels. Obviously, physical separation between jacks will help and/or typical crosstalk approaches may be employed. However, a problem case may be "pair 3" of one channel crosstalking to "pair 3" of another channel, even if the pair 3 plug and jack wires in each channel are remote from each other and the only coupling occurs between the routed cabling. This form of alien NEXT occurs because of pair to pair unbalances that exist in the plug-jack combination, which results in mode conversions from differential NEXT to common mode NEXT and vice versa. To reduce this form of alien NEXT, shielded systems containing shielded twisted pairs or foiled twisted pair configurations may be used. However, the inclusion of shields can increase cost of the system. Another approach to reduce or minimize alien NEXT utilizes spatial separation of cables within a channel and/or spatial separation between the jacks in a channel. However, this is typically impractical because bundling of cables and patch cords is common practice due to "real estate" constraints and ease of wire management.

In spite of recent strides made in improving mated connector (i.e., plug-jack) performance, and in particular reducing crosstalk at elevated frequencies (e.g., 500 MHz—see U.S. patent application Ser. No. 10/845,104, entitled NEXT High Frequency Improvement by Using Frequency Dependent Effective Capacitance, filed May 4, 2004, the disclosure of which is hereby incorporated herein by reference), channels utilizing connectors that rely on either these teachings or those of the '358 patent can still exhibit unacceptably high alien NEXT at very high frequencies (e.g., 500 MHz). As such, it would be desirable to provide connectors and channels used thereby with reduced alien NEXT at very high frequencies.

One specific type of communications jack is illustrated in U.S. Pat. No. 6,443,777 to McCurdy, the disclosure of which is hereby incorporated herein in its entirety, and is shown in FIGS. 1 through 2B. In this jack, which is designated broadly at 10, contact wires 12 that serve as signal conductors are mounted to the rear of the jack 10 in cantilever fashion and extend into a window 18 formed in the front wall 16 of the housing 14 of the jack 10 that is sized to receive a mating plug. The contact wires 12 are mounted on a printed wiring board (PWB) 44, which has conductive traces to carry signals to terminals mounted on the jack 10. A cover 22 holds the contact wires 12 in place. As can be seen in FIGS. 1A and 2, the contact wires 12 of the jack 10 have free end sections 19 that are generally parallel to each other. In front of the locations 20 on the contact wires 12 that the blades of a mating plug contact, no current flows, so only capacitive coupling (and accompanying crosstalk) occurs between individual lead frames 12 at these locations. Rearward of this contact point, in which current flows, both inductive and capacitive coupling/crosstalk occur.

The cross-section of the contact wires 12 at the contact point is shown in FIG. 2A. Pair to pair calculated crosstalk values for this section of the jack are set forth below in Table 1.

TABLE 1

NEAR END CROSSTALK RESULTS - INLINE STRUCTURE

| | Pair A to B DIFF TO DIFF NEXT | | | Pair A to B DIFF TO COM NEXT | | | Pair B to A DIFF TO COM NEXT | | |
|---|---|---|---|---|---|---|---|---|---|
| Pair A to B | XL | XC | TOTAL | XL | XC | TOTAL | XL | XC | TOTAL |
| 1 to 3 | −21.65 | −3.76 | −25.01 | 0 | 0 | 0 | 0 | 0 | 0 |
| 3 to 2 | −7.38 | −1.27 | −8.65 | 17.78 | 3.51 | 21.29 | −7.13 | −1.87 | −9.00 |
| 1 to 2 | 1.85 | 0.55 | 2.40 | −5.38 | −0.88 | −6.26 | −5.38 | −0.88 | −6.26 |

units for all values in mV/V/in.

In Table 1, as well in subsequent tables to be presented, all tabulated inductive responses (XL) were derived using calculations that assumed magnetic coupling between line filaments, and tabulated capacitive responses (XC) used calculations based on capacitive coupling between circular wires having circumference equivalent to actual 10×17 mil cross-sections. (Equation references are in Walker, *Capacitance, Inductance, and Crosstalk Analysis*, Sections 2.2.8 and 2.3.8). The latter calculations are also approximate because shielding effects are not taken into consideration, but the results are sufficient for demonstrating significant contrasts. Further, differential to common mode reponses (DIFF TO COM NEXT) assume a common mode impedance of 75 ohms, a value whose absolute value need not be exact for this purpose. Due to the symmetry of the contact wire arrangement, differential to differential NEXT responses (DIFF to DIFF NEXT) of pair 1 to side pair 4 or pair 3 to side pair 4 is identical in magnitude and polarity to pair 1 to side pair 2 and pair 3 to side pair 2, respectively. However DIFF to COM NEXT responses for pair 1 to 4 (or 4 to 1) and pair 3 to pair 4 (or 4 to 3) have the same magnitude, but of opposite polarity of pair 1 to 2 (or 2 to 1) and pair 3 to pair 2 (or 2 to 3), respectively.

The polarity of the crosstalk generated by the inline structure of FIG. 2A is the same as that generated by the front end of a typical communication plug due to its inline wiring layout and configuration of the plug blades; hence, the large negative pair 1 to pair 3 (1–3) differential to differential NEXT (inductive plus capacitive) is non-compensating and counterproductive. Similar conclusions apply to the other pair combinations. Because the 1–3 pair combination generates a large differential to differential NEXT, compensation for the 1–3 pair can be difficult, but can be partially generated in the remaining parts of the lead frame. Balance of the 1–3 pair combination is not an issue as indicated by the 0 values for differential to common mode NEXT conversion. However, the differential to common mode pair 3 to 2 and pair 2 to 3 NEXT levels are comparatively large, indicating a large unbalance for these pair combinations. The pair 1 to 2 and pair 2 to 1 values also indicate unbalance, but to a lesser extent. It is primarily the large pair 3 to 2 and pair 2 to 3 unbalance, as well as the corresponding pair 3 to 4 and pair 4 to 3 unbalance, that can contribute to poor channel alien NEXT performance. A better balanced lead frame, particulary for the pair 3 to pairs 2 and 4 differential to common mode conversions, would be desirable.

In some prior jacks, the individual contact wires of the jack are made to separate from each other on the lead frame as they approach the PWB into which they mount and terminate. The resulting stagger pattern is seen in U.S. Pat. No. 6,086,428 to Pharney et al. The cross-section of this region of contact wires of such a jack is shown in FIG. 2B, and, for a final stagger height of 0.1 inch, the per unit length NEXT values are shown in Table 2. This would be the case for the lead frame of FIG. 2 without the "jog" created by the laterally traversing section present in the contact wires of pair 1.

TABLE 2

NEAR END CROSSTALK RESULTS - STAGGER PATTERN

| | Pair A to B DIFF TO DIFF NEXT | | | Pair A to B DIFF TO COM NEXT | | | Pair B to A DIFF TO COM NEXT | | |
|---|---|---|---|---|---|---|---|---|---|
| Pair A to B | XL | XC | TOTAL | XL | XC | TOTAL | XL | XC | TOTAL |
| 1 to 3 | 15.02 | 1.45 | 16.47 | 2.88 | 0.42 | 3.30 | −2.88 | −0.42 | −3.30 |
| 3 to 2 | 9.78 | 0.95 | 10.73 | 11.03 | 1.61 | 12.64 | −0.265 | 0.387 | 0.120 |
| 1 to 2 | 10.02 | 1.11 | 11.13 | −5.38 | −0.88 | −6.26 | −5.38 | −0.88 | −6.26 |

units for all values in mV/V/in.

Notably, the per unit length coupling polarity has flipped relative to the in-line configuration for the differential to differential NEXT of the 1–3 and 2–3 pair combinations, so these pair combinations now yield compensating coupling. (Again, differential to differential NEXT for the 3–4 pair combination is the same as the 2–3 pair combination). Dimensionally, the longer the lead frame is after the polarity has flipped and before attachment to the PWB, the more cross talk compensation is introduced. It has been the 1–3 and 2–3 differential to differential compensation aspects that have rendered the stagger pattern advantageous (even though the 1–2 differential to differential NEXT is counterproductive, the levels are such that normal compensating procedures on the PWB have been sufficient). But with higher performance standards, balance is now a significant variable, and the large counterproductive differential to common mode pair 3 to pair 2 (and pair 3 to pair 4) mode conversion of the stagger pattern is highly undesirable.

The prior jack lead frame embodiment shown in FIG. 2 employs a contact wire configuration that not only staggers, but also has leads that include laterally traversing sections (termed herein "traverses") that vary the coupling of the contact wires of the jack. For example, after the leads stagger apart, the leads of pair 1 "jog" laterally to closely couple the "tips" of pairs 1 and 3 and the "rings" of pairs 1 and 3. FIG. 2C shows the resulting final cross section, and Table 3 shows the cross talk levels reached, after pair 1 traverses closer to pair 3 and a separation height of 0.1 inch has been reached. (This height is choosen for direct comparison to results given in Table 2 above had a conventional stagger pattern been maintained.)

TABLE 3

NEAR END CROSSTALK RESULTS - STAGGER AND TRAVERSE

| | Pair A to B DIFF TO DIFF NEXT | | | Pair A to B DIFF TO COM NEXT | | | Pair B to A DIFF TO COM NEXT | | |
|---|---|---|---|---|---|---|---|---|---|
| Pair A to B | XL | XC | TOTAL | XL | XC | TOTAL | XL | XC | TOTAL |
| 1 to 3 | 36.28 | 3.49 | 39.77 | 0 | 0 | 0 | 0 | 0 | 0 |
| 3 to 2 | 9.78 | 0.95 | 10.73 | 11.03 | 1.61 | 12.64 | −0.265 | 0.145 | −0.130 |
| 1 to 2 | 8.01 | 0.89 | 8.9 | 2.99 | 0.38 | 3.37 | −2.99 | −0.38 | −3.37 |

units for all values in mV/V/in.

Although differential to differential compensation levels are about the same as the staggered pattern of FIG. 2B for pairs 3 to 2 and pairs 1 to 2, the pair 1 to pair 3 differential to differential compensation efficiency increased dramatically (39.77 mV/V/in from 16.5 mV/V/in) with the addition of the lateral traverses in pair 1. The efficient 1–3 differential to differential compensating ability of this lead frame can be very desirable. The pair 1 to 2 differential to differential NEXT is counterproductive (as would be pair 1 to 4), albeit manageable for some levels of jack performance but it has been found to be manageable. However, even with this jack's improved 1–3 differential to differential compensating ability, Table 3 demonstrates that the jack still has serious differential to common mode NEXT conversion problems for the pairs 3 to 2 (and pairs 3 to 4) combinations. The same mode conversion levels are generated that the stagger pattern alone revealed (12.64 mV/V/in). This means that the pair 3 to 2 mode conversion of the very unbalanced inline section (i.e., the free end segments of the contact wires) would be added to the counterproductive levels generated in transition regions (where some in-line geometry is followed by staggering), and subsequent regions after pair 1 traverses. A similar issue arises with jacks incorporating the simple staggered leadframe of FIG. 2B. Hence, these prior lead frames only partially reduce the mode unbalance of the pair 3 to 2 and pair 3 to 4 differential to common mode NEXT relative to maintaining the in-line geometry over the same length. Although the pair 1 to 2 and 2 to 1 differential to differential and differential to common mode levels are reduced with the cantilever from the rear lead frame of FIG. 2C, the large 3 to 2 unbalance can still be problematic.

U.S. Pat. No. 6,443,777 to McCurdy, supra, discloses a prior art jack in which the fixed end segments of pair 3 include traverses that cause portions of the fixed end segments of the contact wires of pairs 1 and 3 to form a rectangle (see FIG. 2D).

SUMMARY OF THE INVENTION

As a first aspect, the present invention is directed to a communications jack, comprising: a dielectric mounting substrate; and a plurality of contact wires, each of the contact wires having a contact segment, a compensating segment in electrical connection with the contact segment, and a base in electrical connection with the compensating segment and mounted in the mounting substrate. The contact segments are generally transversely aligned and parallel with each other. The contact segments are arranged in pairs, with a first pair of contact segments being immediately adjacent each other, a second pair of contact segments being immediately adjacent each other and positioned one side of the first pair, a fourth pair of contact segments being immediately adjacent each other and positioned on an opposite side of the first pair, and a third pair of contact segments sandwiching the first pair, with one of the contact segments of the third pair being disposed between the first and second pairs, and the other of the contact segments being disposed between the first and fourth pairs. Sections of the compensation segments of the second pair are substantially vertically aligned with each other, and sections of the compensation segments of the fourth pair are substantially vertically aligned with each other. This configuration can improve differential to common mode crosstalk compensation, particularly between the contact wires of the third pair and the second and fourth pairs of contact wires.

As a second aspect, the present invention is directed to a communications jack, comprising: a dielectric mounting substrate; and a plurality of contact wires, each of the contact wires having a contact segment, a compensating segment in electrical connection with the contact segment, and a base in electrical connection with the compensating segment and mounted in the mounting substrate. The contact segments are generally transversely aligned and parallel with each other. The contact segments are arranged in pairs, with a first pair of contact segments being immediately adjacent each other, a second pair of contact segments being immediately adjacent each other and positioned one side of the first pair, a fourth pair of contact segments being immediately adjacent each other and positioned on an opposite side of the first pair, and a third pair of contact segments sandwiching the first pair, with one of the contact segments of the third pair being disposed between the first and second pairs, and the other of the contact segments being disposed between the first and fourth pairs. At least one of sections of the compensation segments of the first pair and sections of the compensation segments of the third pair are substantially vertically aligned. In some embodiments, both the sections of the compensation segments of the first pair and the sections of the compensation segments of the third pair are substantially vertically aligned. Again, in this configuration, improved differential to common mode crosstalk compensation, particularly between the contact wires of the third pair and the second and fourth pairs of contact wires, can result.

As a third aspect, the present invention is directed to a communications jack, comprising: a dielectric mounting substrate; and a plurality of contact wires, each of the contact wires having a contact segment, a compensating segment in electrical connection with the contact segment, and a base in electrical connection with the compensating segment and mounted in the mounting substrate. The contact segments are generally transversely aligned and parallel with each other. The contact segments are arranged in pairs, with a first pair of contact segments being immediately adjacent each other, a second pair of contact segments being immediately adjacent each other and positioned one side of the first pair, a fourth pair of contact segments being immediately adjacent each other and positioned on an opposite side of the first pair, and a third pair of contact segments sandwiching the first pair, with one of the contact segments of the third pair being disposed between the first and second pairs, and the other of the contact segments being disposed between the first and fourth pairs. The compensating segments are configured and arranged such that differential to common mode crosstalk generated between the contact segments of the second and third pairs is opposite in polarity to the differential to common mode crosstalk generated between the compensating segments of the second and third pairs. Once again, this configuration can improve differential to common mode crosstalk compensation, particularly between the contact wires of the third pair and the second and fourth pairs of contact wires.

DETAILED DESCRIPTION OF EMBODIMENTS OF THE INVENTION

Figure 1:
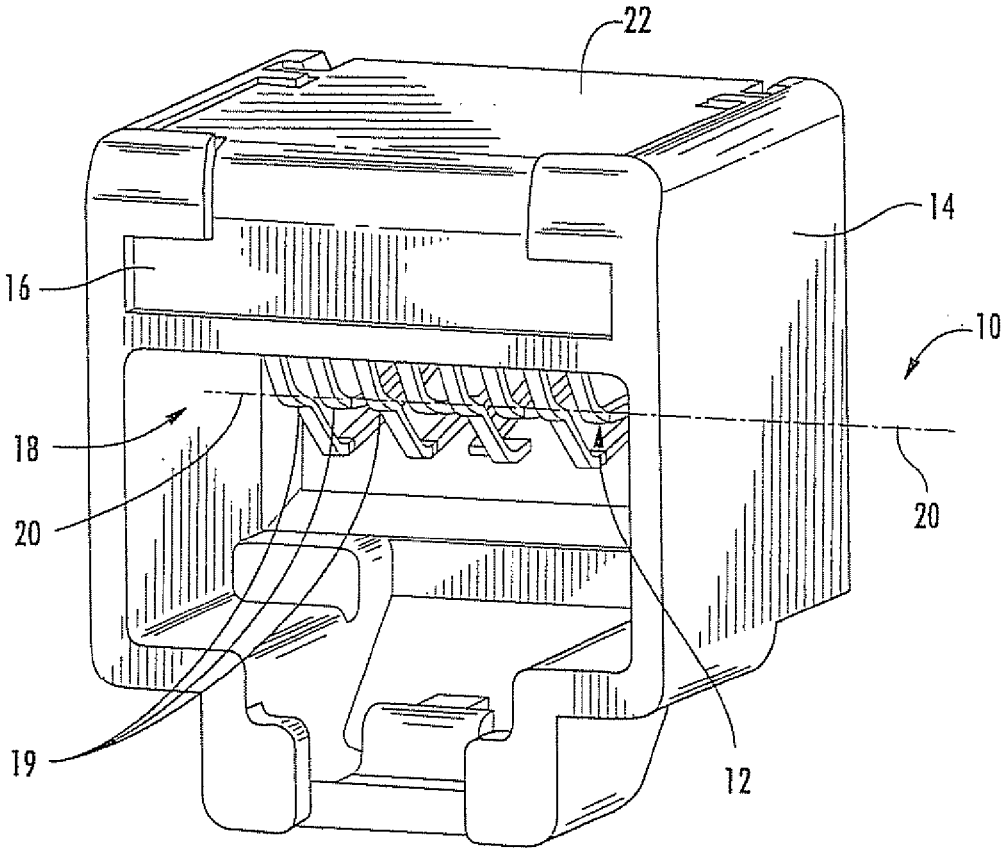
FIG. 1 is a perspective view of a prior art communications jack.
Figure 1A:
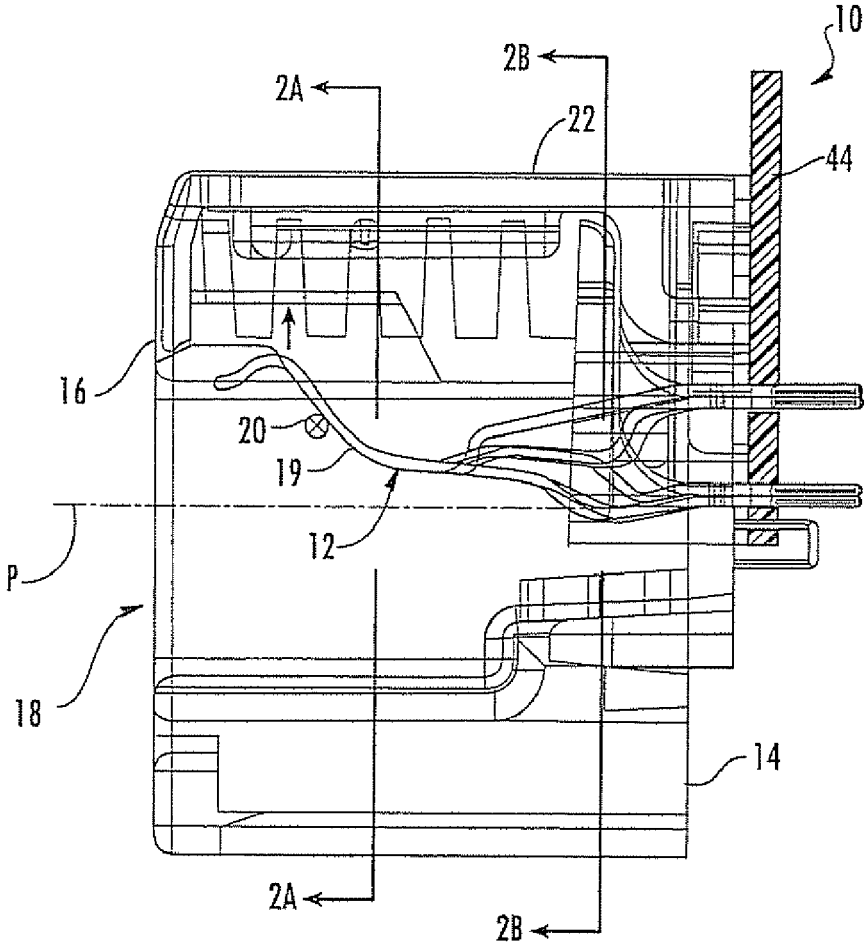
FIG. 1A is a side section view of the jack of FIG. 1 taken along lines 1A—1A thereof.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

This invention is directed to communications connectors, with a primary example of such being a communications jack. As used herein, the terms "forward", "forwardly", and "front" and derivatives thereof refer to the direction defined by a vector extending from the center of the jack toward the plug opening of the jack. Conversely, the terms "rearward", "rearwardly", and derivatives thereof refer to the direction directly opposite the forward direction; the rearward direction is defined by a vector that extends away from the plug opening toward the remainder of the jack. Together, the forward and rearward directions define the "longitudinal" dimension of the jack. The terms "lateral," "outward", and derivatives thereof refer to the direction generally parallel with the plane defined by a wiring board on which jack contact wires are mounted and extending away from a plane bisecting the jack in the center. The terms "medial," "inward," "inboard," and derivatives thereof refer to the direction that is the converse of the lateral direction, i.e., the direction parallel with the plane defined by the wiring board and extending from the periphery of the jack toward the aforementioned bisecting plane. Together, the lateral and inward directions define the "transverse" dimension of the jack. A line normal to the longitudinal and transverse dimensions defines the "vertical" dimension of the jack.

Where used, the terms "attached", "connected", "interconnected", "contacting", "mounted" and the like can mean either direct or indirect attachment or contact between elements, unless stated otherwise. Where used, the terms "coupled," "induced" and the like can mean non-conductive interaction, either direct or indirect, between elements or between different sections of the same element, unless stated otherwise.

Figure 3:
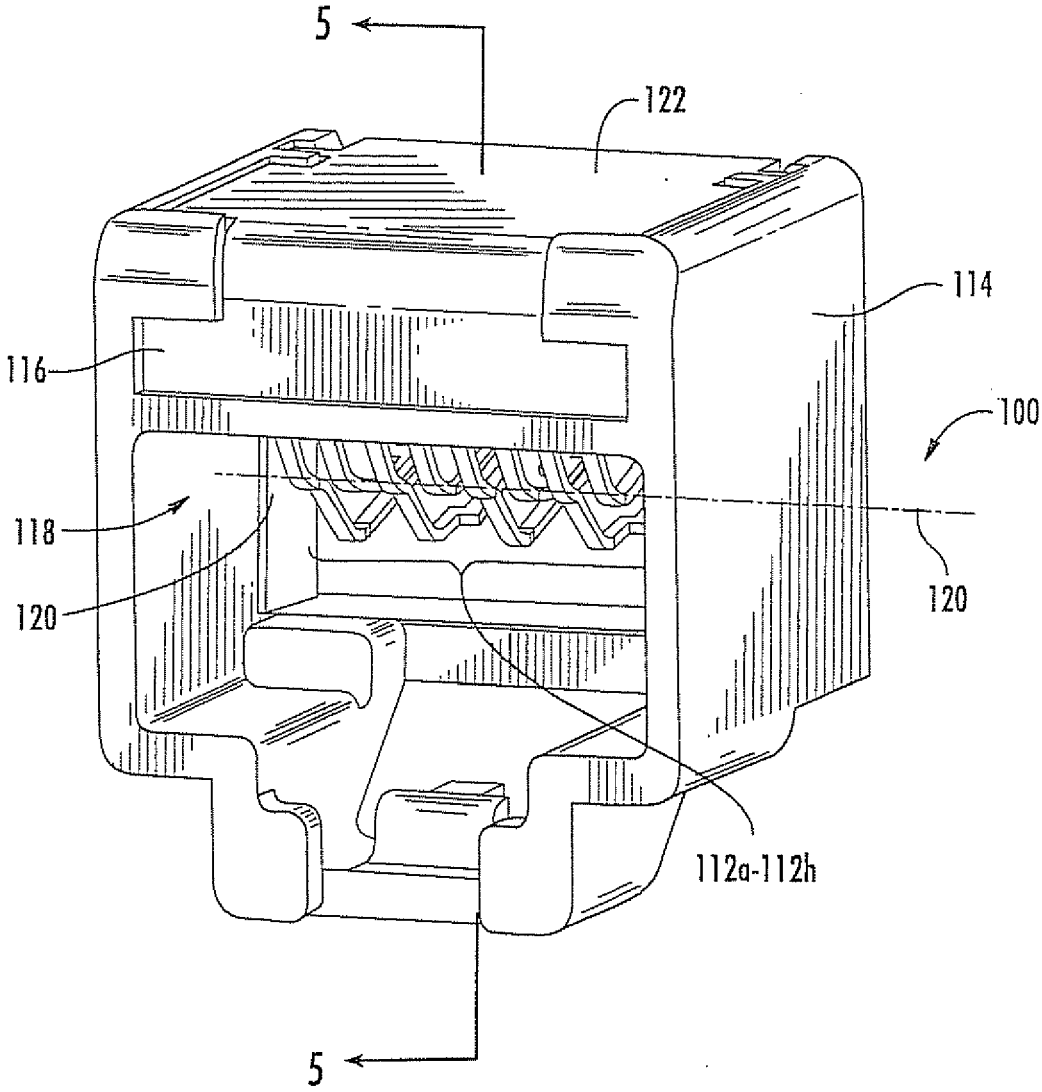
FIG. 3 is a perspective view of a communications jack according to embodiments of the present invention.
Figure 4:
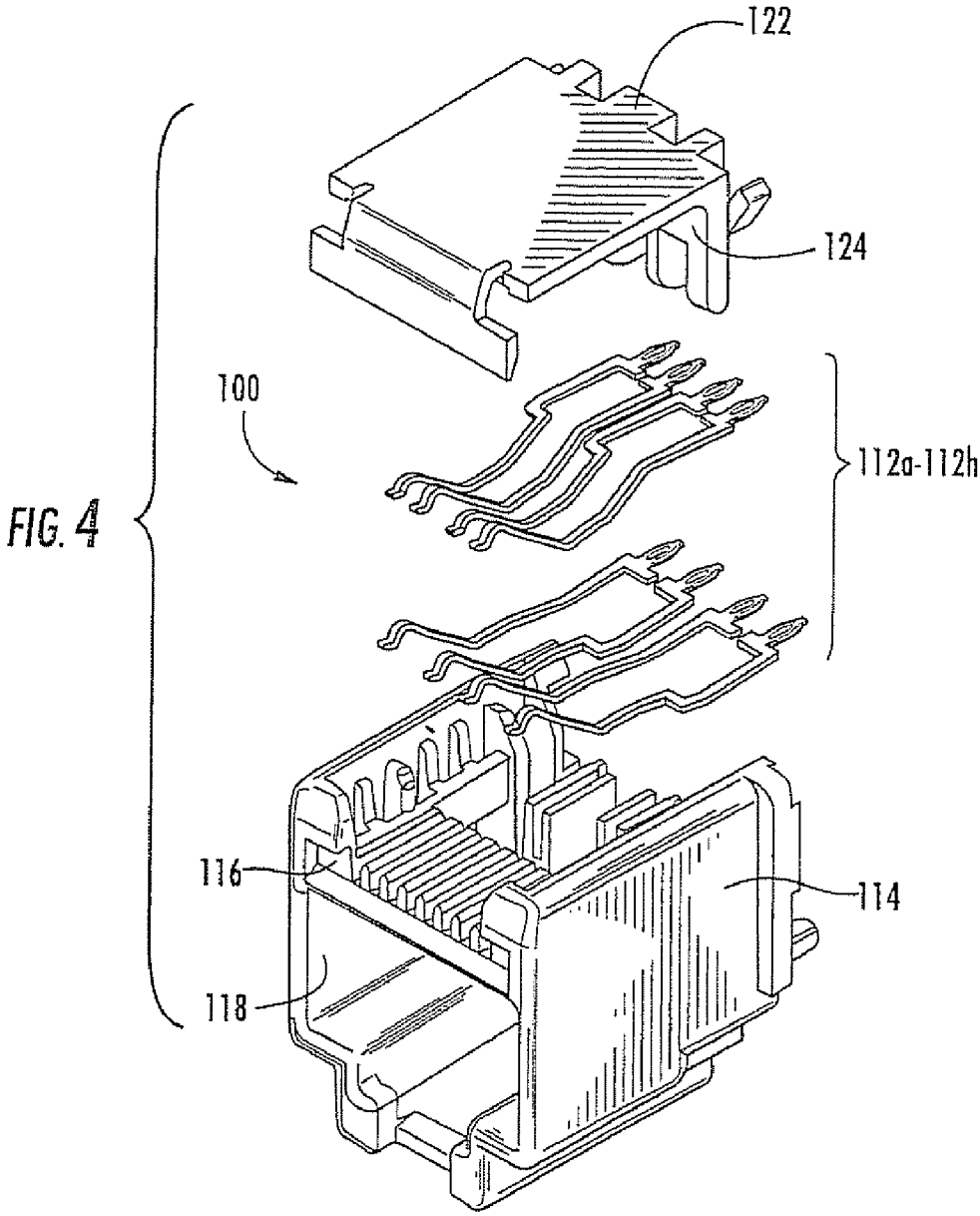
FIG. 4 is an exploded view of the jack of FIG. 3.
Figure 5:
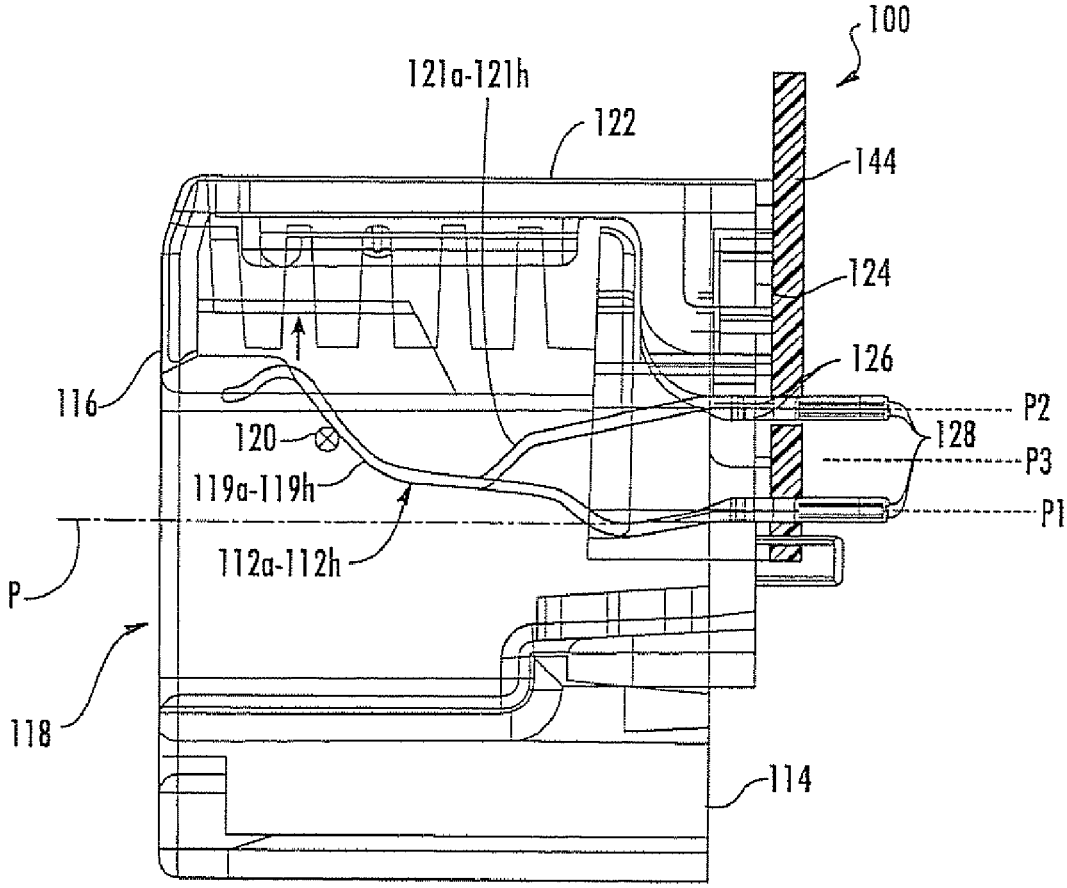
FIG. 5 is a side section view of the jack of FIG. 3 taken along lines 5—5 thereof.

Turning now to the figures, FIG. 3 shows a communication jack, designated broadly at 100. The jack 100 includes a jack housing 114. The housing 114 has a front wall 116 and a plug opening 118 formed in the front wall 116 to allow a mating plug connector (not shown) to be received within the jack housing 114 along the direction of a plug axis P (FIG. 5) that is normal to the front wall 116 of the jack housing 114. As seen in FIGS. 3–5, a generally "L" shaped cover 122 extends across the top of the jack housing 114, and part of the cover 122 forms an upper portion of a rear wall 124 of the housing 114. The jack housing 114 and cover 122 are typically made of a suitable dielectric plastic material that meets all applicable standards with respect to electrical breakdown resistance and flammability. Typical materials include, but are not limited to, polycarbonate, ABS, and blends thereof.

Figure 6:
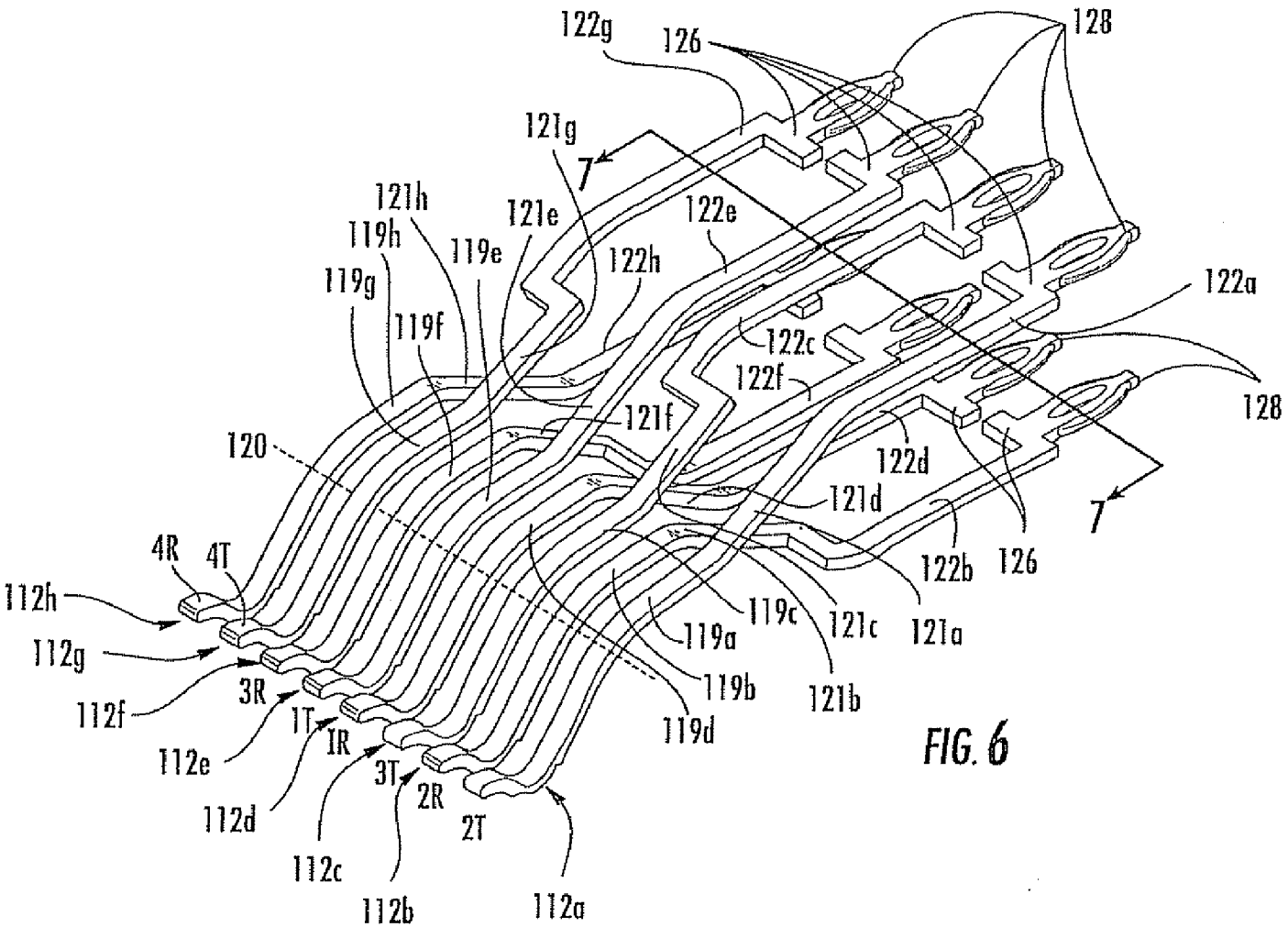
FIG. 6 is an inverted perspective view of the contact wires of the jack of FIG. 3.

Referring to FIGS. 4–6, a set of eight terminal contact or "lead frame" wires 112*a*–112*h* are supported inside of the jack 100. The contact wires 112*a*–112*h* may be formed of a copper alloy such as spring-tempered phosphor bronze, beryllium copper, or the like. A typical cross section of each wire is 0.017 inch wide by 0.010 inch thick. Each of the terminal contact wires 112*a*–112*h* has a base 126 that is captured within corresponding vertical slots formed in the housing rear wall 124, and an outside terminal 128 that projects rearwardly of the PWB 144 to connect electrically with one or more outside wire leads.

When a mating plug is received in the plug opening 118, free end segments 119*a*–119*h* (also termed "contact segments") of the contact wires 112*a*–112*h* establish electrical contact with corresponding terminals of the mating plug along a plug/jack contact line or interface 120 on the free end portions.

The contact segments 119*a*–119*h* of the contact wires 112*a*–112*h* are substantially transversely aligned and parallel with one another, as seen in FIGS. 5 and 6. The contact segments 119*a*–119*h* are spaced apart from one another by, e.g., 0.040 inch. In the disclosed embodiment, the eight contact wires 112*a*–112*h* define four signal paths through the jack 100, wherein selected pairs of the free end portions 19 of the contact wires define the signal paths, per Part 68 of the applicable FCC Rules, 47 C.F.R. §68.502. The adjacent fourth and fifth contact wires counting from the left in FIG. 6 define a so-called "pair 1" signal path, the third and the sixth contact wires which are adjacent to the fourth and the fifth contact wires, respectively, define a so-called "pair 3" signal path, the first and second contact wires define a so-called "pair 4" signal path, and the seventh and eighth contact wires define a so-called "pair 2" signal path. With the contact segments 119*a*–119*h* configured in the substantially aligned and parallel manner illustrated, the crosstalk generated thereby (and that which, in combination with a mating plug, should be compensated) is as set forth in Table 1 above.

Typically, as described above, the greatest amount of offending differential to differential crosstalk is developed in plug connectors among the pair 1 and the pair 3 signal paths. It is therefore desirable to obtain equal and opposite levels of both inductive and capacitive crosstalk compensation among the pair 1 and the pair 3 contact wires 112*a*–112*h*, in the region between the plug/jack interface 120 and the bases 126 of the contact wires 112*a*–112*h* at the rear wall 124 of the jack housing 114. Capacitive coupling may be introduced, for example, via a printed wiring board 144 connected to the bases 126 of the contact wires 112*a*–112*h* at the rear of the jack housing 114. See, e.g., U.S. Pat. No. 6,350,158 to Arnett et al., the disclosure of which is hereby incorporated herein by reference in its entirety. In addition, capacitive and inductive coupling may be introduced by the relative configurations of the contact wires 112*a*–112*h* themselves, as discussed above.

Turning now to FIG. 6, in addition to a respective contact segment 119*a*–119*h*, each of the contact wires 112*a*–112*h* includes a respective fixed end segment 121*a*–121*h* (also termed herein "compensating segments"). As can be seen in FIG. 6, each of the contact segments 119*a*–119*h* extends from its free end rearwardly beyond the plug-jack interface 120 to a point where it merges with its respective compensating segment 121*a*–121*h*, the merger point being the locations on the contact wires where the compensating segments begin to stagger and separate from adjacent contact wires. Each of the compensating segments 121*a*–121*h* terminates at a respective base 126 that, in turn, merges with a terminal 128. The staggering of the compensating segments 121*a*–121*h* is such that the compensating segments 121*b*, 121*d*, 121*f*, 121*h* generally form a horizontal plane P1 (see FIG. 7), and the compensating segments 121*a*, 121*c*, 121*e*, 121*g* generally form a horizontal plane P2 (see FIG. 7). A horizontal plane P3 is positioned equidistant from the compensation segments of pairs 1 and 3 (see FIG. 7).

Figure 7:
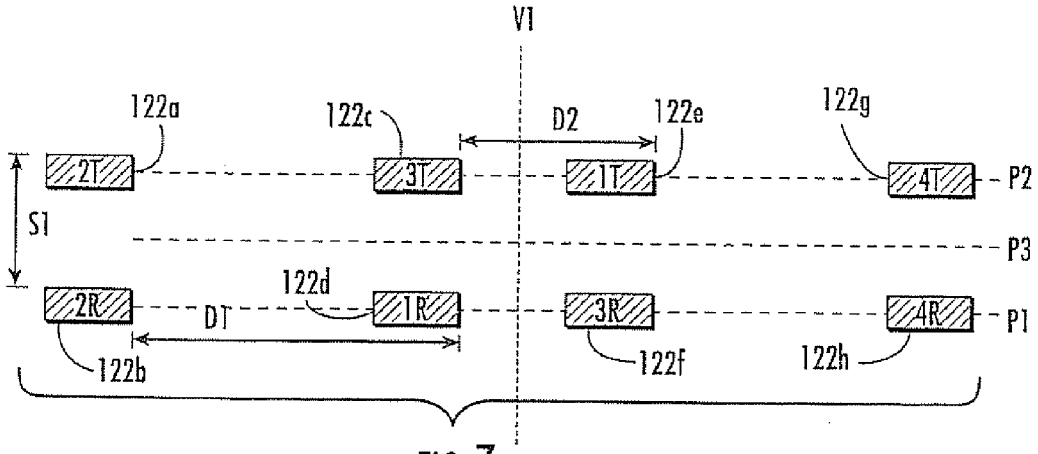
FIG. 7 is a section view of the contact wires of FIG. 6 taken along lines 7—7 thereof.

Between the plug-jack interface 120 and its base 126, each of the four compensating segments 121*a*, 121*d*, 121*e*, 121*h* extend entirely within a plane that is substantially parallel with a vertical plane V1 that extends between the contact segments 119*d*, 119*e* of pair 1 (e.g., the compensating segment 121*h* of the contact wire 112*h*—see FIG. 7). The remaining four of the compensating segments 121*b*, 121*c*, 121*f*, 121*g* include sections that "traverse" a short distance before continuing to extend rearwardly, thereby shifting the transverse positions of substantial sections of these compensating segments. As can be seen in FIG. 7, the traversing of four of the compensating segments 121*b*, 121*c*, 121*f*, 121*g* positions them such that sections 122*a*, 122*b* of the compensating segments 121*a*, 121*b* of pair 2 are substantially vertically aligned, the sections 122*g*, 122*h* of the compensating segments 121*g*, 121*h* of pair 4 are substantially vertically aligned, and sections 122*c*, 122*d*, 122*e*, 122*f* of the compensating segments 121*c*, 121*d*, 121*e*, 121*f* of pairs 1 and 3 form a rectangle. The sections 122*a*, 122*b* are substantially the same distance from the plane V1 as the sections 122*g*, 122*h*.

In the illustrated embodiment, the stagger distance S1 between the sections 122*b*, 122*d*, 122*f*, 122*h* and the sections 122*a*, 122*c*, 122*e*, 122*g* is 0.1 inch, although this distance may vary. Also, the transverse distance D1 between the sections 122*b* and 122*d* is 0.12 inch, and the transverse distance D2 between the sections 122*e* and 122*c* is 0.04 inch, although each of these distances may vary.

In this configuration, the differential to differential and differential to common mode crosstalk values can be calculated (under the method described above) and are set forth in Table 4.

TABLE 4

NEAR END CROSSTALK RESULTS FOR WIRE SECTIONS OF FIG. 7

| | Pair A to B DIFF TO DIFF NEXT | | | Pair A to B DIFF TO COM NEXT | | | Pair B to A DIFF TO COM NEXT | | |
|---|---|---|---|---|---|---|---|---|---|
| Pair A to B | XL | XC | TOTAL | XL | XC | TOTAL | XL | XC | TOTAL |
| 1 to 3 | 28.6 | 3.15 | 31.75 | 0 | 0 | 0 | 0 | 0 | 0 |
| 3 to 2 | 6.63 | 0.76 | 7.39 | 3.68 | 0.48 | 4.16 | 0.77 | 0.13 | 0.90 |
| 1 to 2 | 6.63 | 0.76 | 7.39 | −3.68 | −0.48 | −4.16 | −0.77 | −0.13 | −0.90 |

units for all values in mV/V/in.

Figure 2:
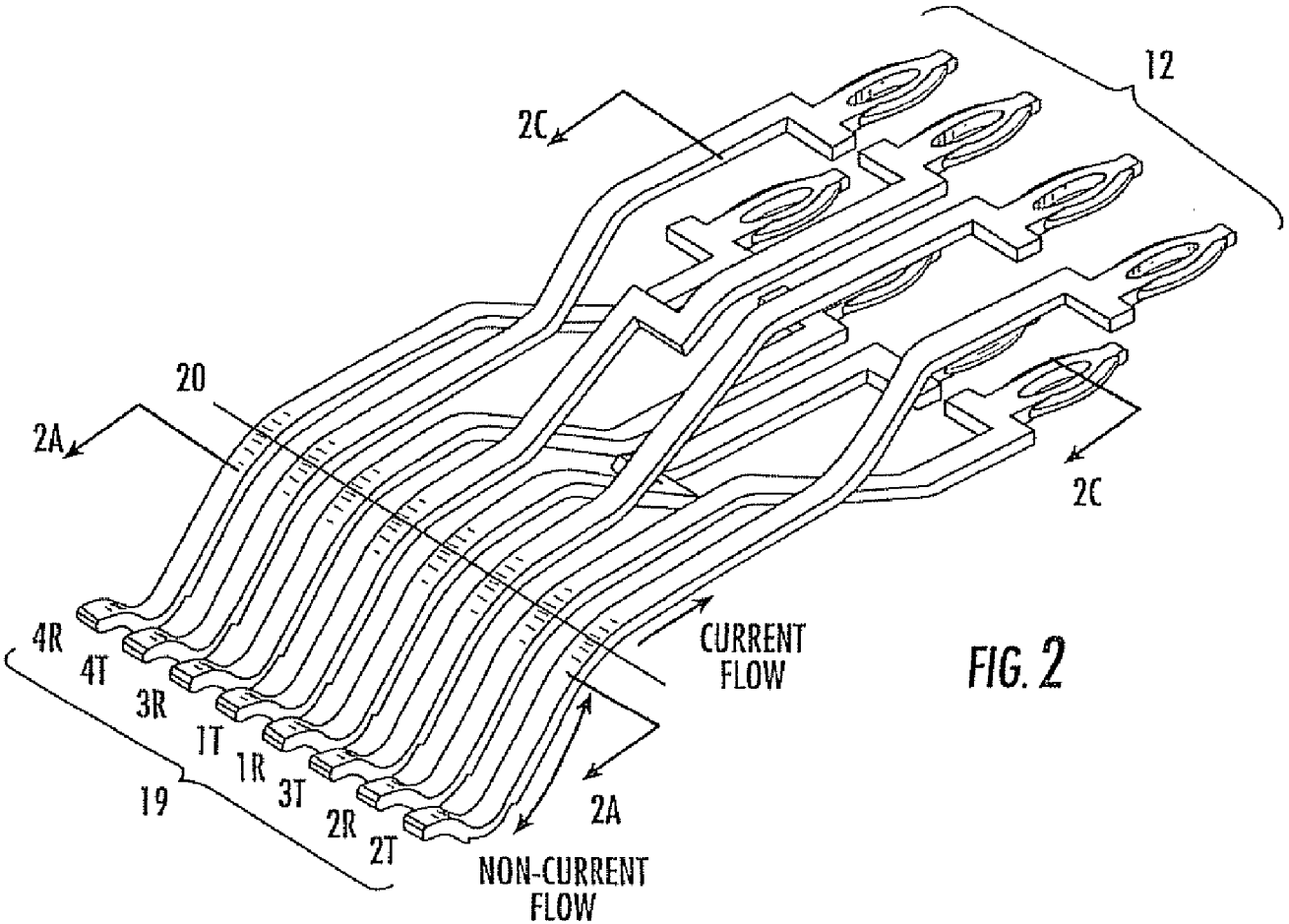
FIG. 2 is an inverted perspective view of the contact wires of the jack of FIG. 1.
Figure 2A:
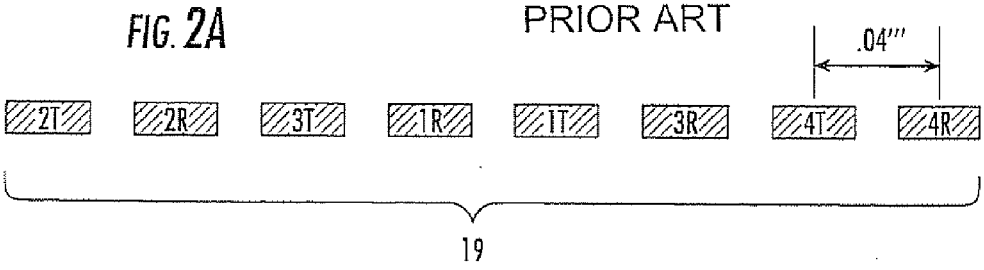
FIG. 2A PRIOR ART
FIG. 2A is a section view of the leadframes of the jack of FIG. 1 at the contact point of the leadframes with a mating plug.
Figure 2B:
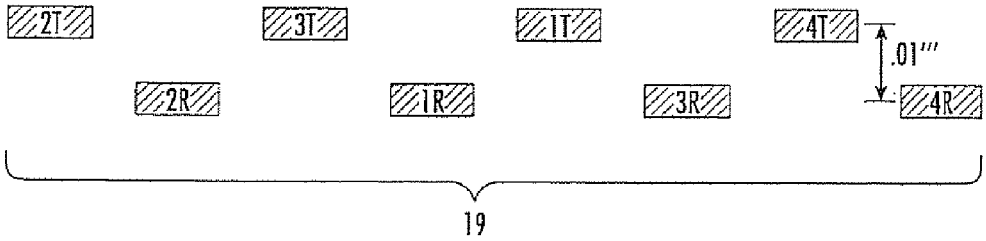
FIG. 2B PRIOR ART
FIG. 2B is a section view of the leadframes of an alternative prior art jack taken at a point where the contact wires just stagger from each other.
Figure 2C:
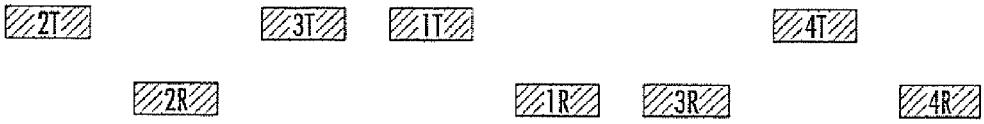
FIG. 2C PRIOR ART
FIG. 2C is a section view of the leadframes of an alternative prior art communications jack taken at the point where the contact wires stagger from each other.
Figure 2D:
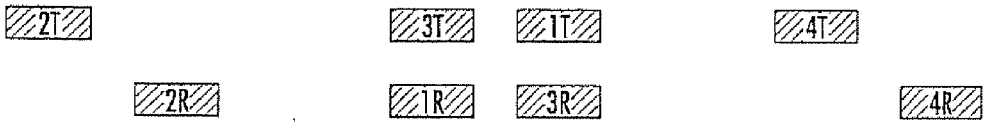
FIG. 2D PRIOR ART
FIG. 2D is a section view of the leadframes of another alternative prior art communications jack taken at the point where the contact wires stagger from each other.

It can be seen that the large pair 3 to 2 differential to common mode crosstalk is reduced significantly below that of the prior art jack of FIG. 2C (see Table 3 above). The pair 2 to 3 mode conversion remains low and is largely immaterial. Also, the negative attributes of pair 1 to 2 differential to differential crosstalk and differential to common mode crosstalk are reduced and become even more manageable than those shown for the prior art jack in Table 3.

Figure 8:
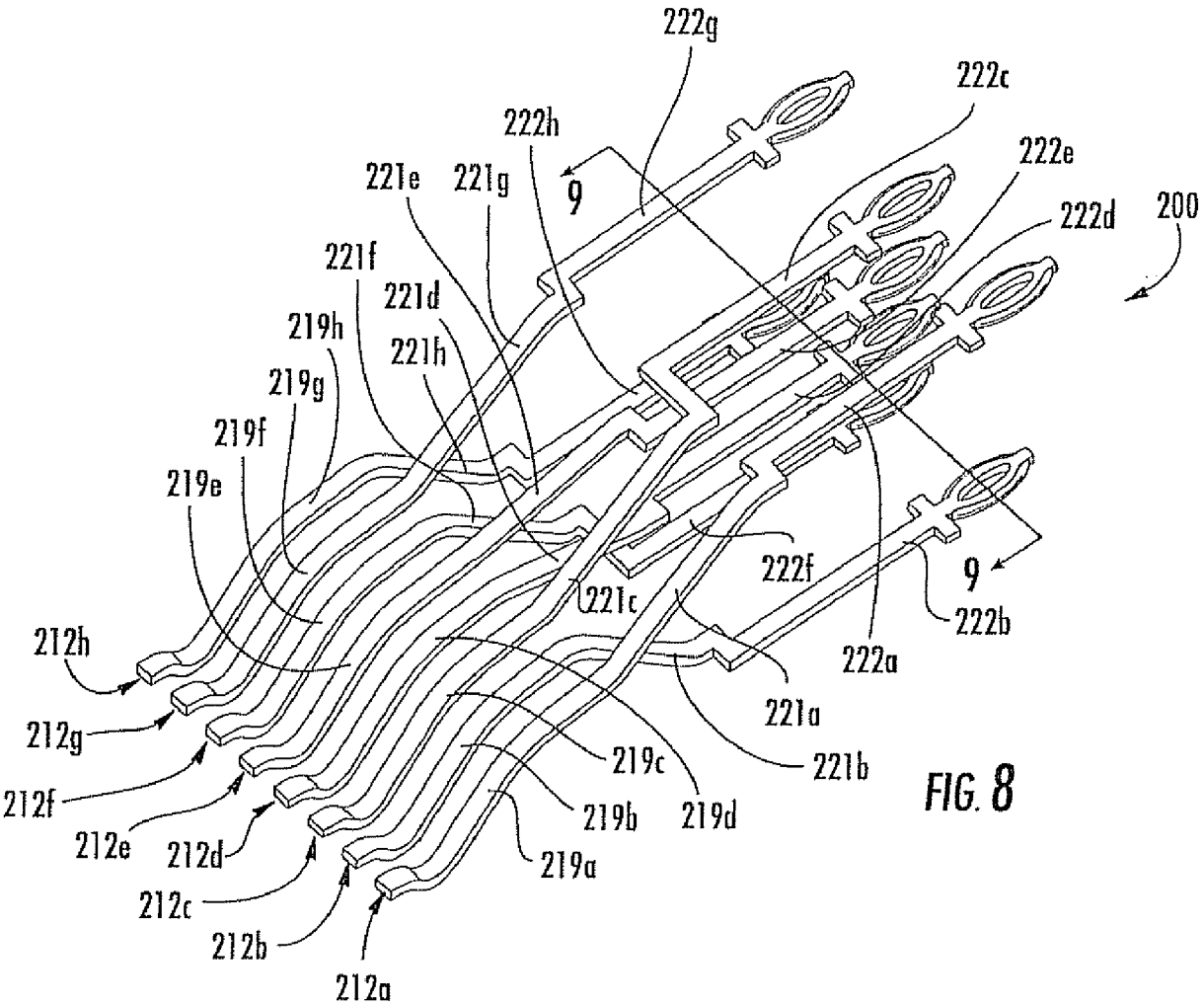
FIG. 8 is an inverted perspective view of contact wires for a communications jack according to alternative embodiments of the present invention.
Figure 9:
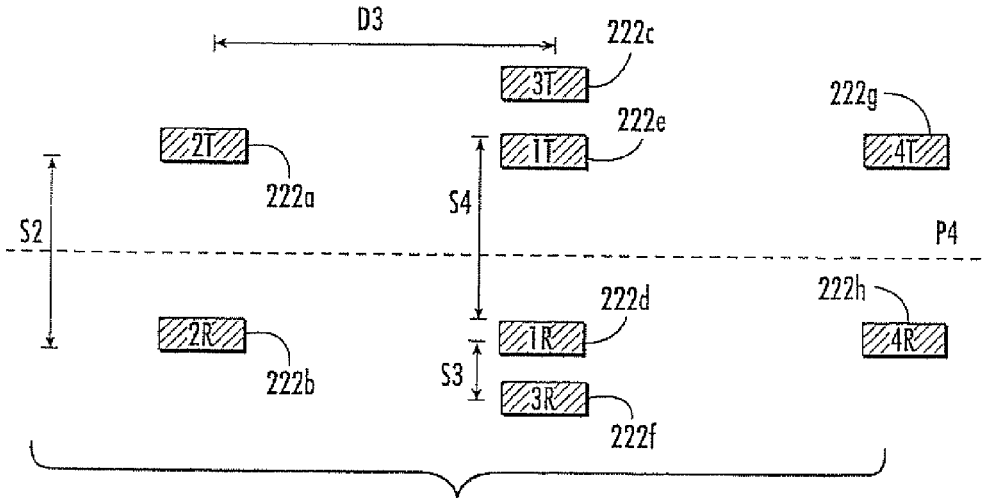
FIG. 9 is a section view of the contact wires of FIG. 8 taken along lines 9—9 thereof.

Turning now to FIGS. 8 and 9, another embodiment of an arrangement of contact wires for a jack of the present invention, designated broadly at 200, is shown therein. The contact wires 212*a*–212*h* each have a contact segment 219*a*–219*h* and a compensating segment 221*a*–221*h*. The contact segments 219*a*–219*h* are arranged as in the jack embodiment 100 of FIGS. 3–7. Each of the compensating segments 221*a*–221*h* includes a traverse, such that none of the compensating segments 221*a*–221*h* is aligned with its respective contact segment 219*a*–219*h*. Each of the compensating segments 221*a*, 221*b*, 221*d*, 221*e*, 221*g*, 221*h* of pairs 2, 1 and 4 includes a relatively small traverse which enables a section 222*a*–222*h* of each compensating segment to align substantially vertically with a section of its corresponding compensating segment for that pair (e.g., compensating segments 221*a* and 221*b* of pair 2 include small traverses in opposite lateral directions that bring sections 222*a*, 222*b* of the segments into vertical alignment; the same is true for sections 222*d*, 222*e* of segments 221*d* and 221*e* of pair 1 and sections 222*g*, 222*h* of segments 221*g* and 221*h* of pair 4). Each of compensating segments 221*c* and 221*f* of pair 3 includes a relatively larger traverse that enables the sections 222*c*, 222*f* of these segments to align vertically with each other. Also, in this embodiment, the vertically aligned sections 222*c*, 222*f* of the compensating segments 221*c*, 221*f* of pair 3 align vertically with the sections 222*d*, 222*e* of the compensating segments 221*d*, 221*e* of pair 1. In addition, in this embodiment, the compensating segments of each pair are substantially equidistant from a horizontal plane P4 that bisects the compensating segments (see FIG. 9).

In the illustrated embodiment, the stagger distance S2 between the sections 222*a*, 222*b* is 0.1 inch, the stagger distance S3 between the sections 222*e*, 222*c* is 0.04 inch, and the stagger distance S4 between the sections 222*d*, 222*e* is 0.1 inch, although these distances may vary. Also, the transverse distance D3 between the sections 222*g*, 222*h* and the substantially vertically aligned sections 222*c*, 222*e*, 222*d*, 222*f* is 0.12 inch, although this distance may vary.

In this configuration, the differential to differential and differential to common mode crosstalk values can be calculated (under the method described above) and are set forth in Table 5.

TABLE 5

NEAR END CROSSTALK RESULTS FOR WIRE SECTIONS OF FIG. 9

| Pair | Pair A to B DIFF TO DIFF NEXT | | | Pair A to B DIFF TO COM NEXT | | | Pair B to A DIFF TO COM NEXT | | |
|---|---|---|---|---|---|---|---|---|---|
| A to B | XL | XC | TOTAL | XL | XC | TOTAL | XL | XC | TOTAL |
| 1 to 3 | 39.04 | 3.69 | 42.73 | 0 | 0 | 0 | 0 | 0 | 0 |
| 3 to 2 | 11.66 | 1.11 | 12.77 | 0 | 0 | 0 | 0 | 0 | 0 |
| 1 to 2 | 8.17 | 0.96 | 9.13 | 0 | 0 | 0 | 0 | 0 | 0 |

units for all values in mV/V/in.

This configuration has no mode coversions in the region analyzed and therefore does not add to the detrimental mode conversions generated by typical plugs and or the front end geometries of the lead frame. Further, the differential to differential NEXT compensation for the 1 to 3 and 2 to 3 pair combinations are very efficient for compensation. The pair 1 to 2 differential to differential NEXT compensation is still counterproductive, but may be more manageable, as the values produced are comparable to those of the embodiment analyzed in Table 3.

It should be noted that some unbalance may still exist with the contact wire arrangements of FIGS. 3–9 because unbalance occurs in the inline section where the plug intersects the leadframe and in the transition region. Also, in the preceding discussion, it is assumed that in the transition region, when the contact wires veer from the in-line pattern of the free end sections to the staggered pattern of the fixed end sections, staggering takes place uniformly: all "tips" move upwardly, and all "rings" move downwardly, in synch with each other.

Figure 11:
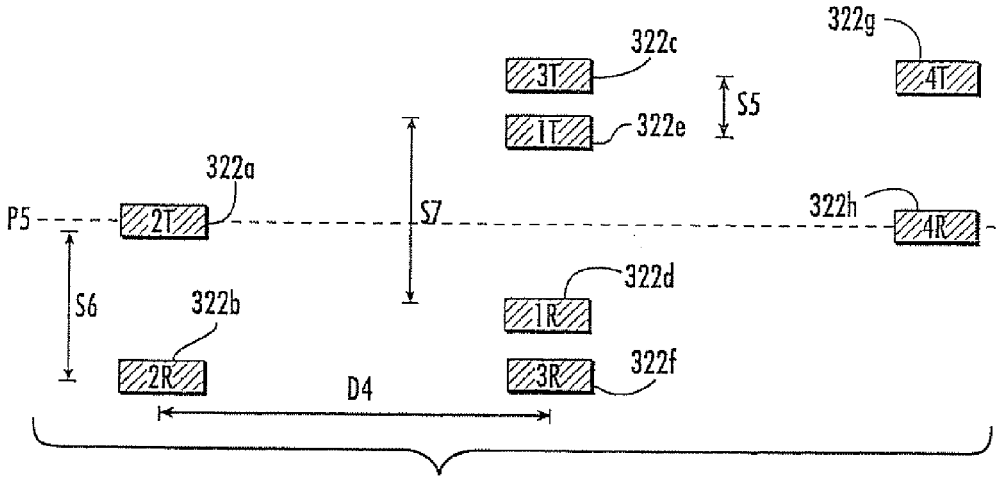
FIG. 11 is a section view of the contact wires of FIG. 10 taken along lines 11—11 thereof.
Figure 10:
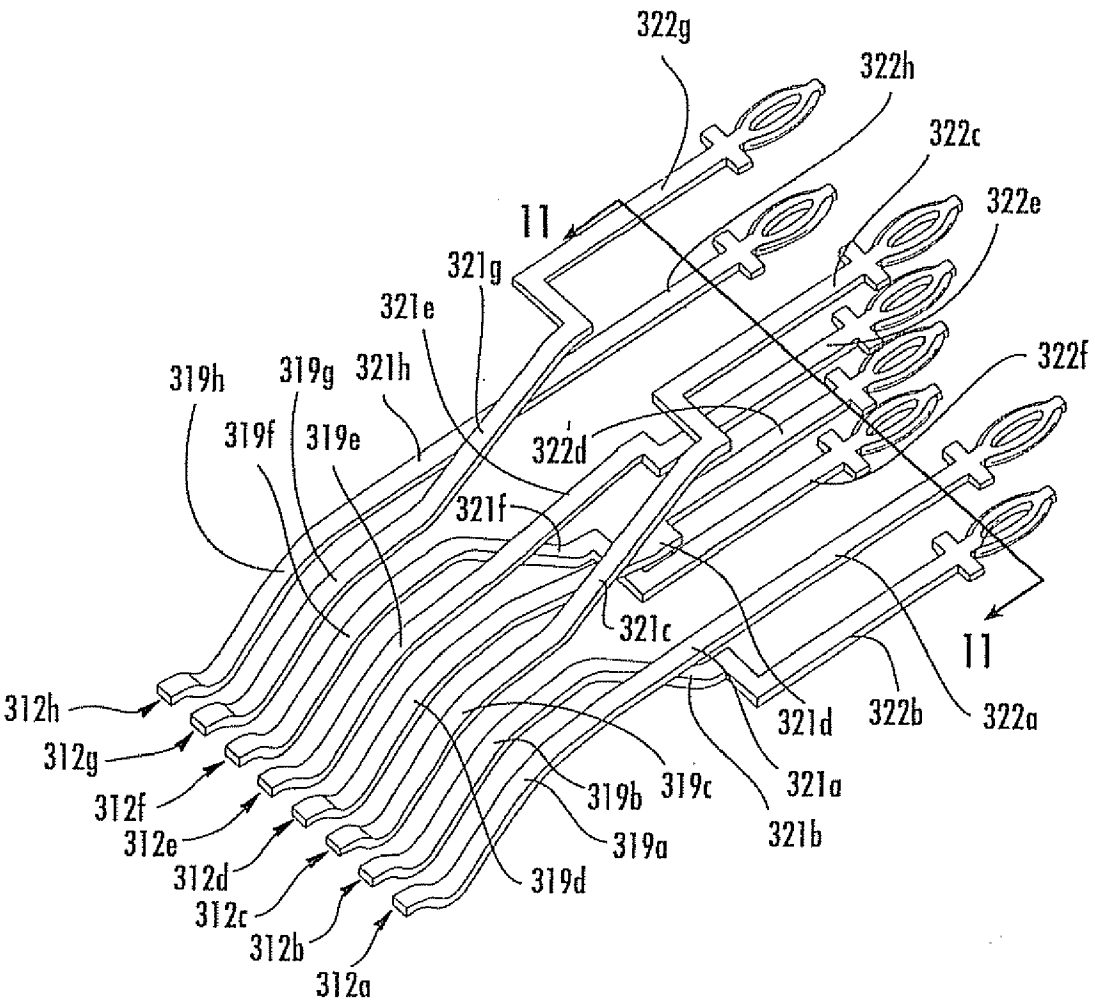
FIG. 10 is an inverted perspective view of contact wires for a communications jack according to further embodiments of the present invention.

Referring now to FIGS. 10 and 11, another embodiment of an arrangement of leadframes for a jack of the present invention, designated broadly at 300, is shown therein. The contact wires 312*a*–312*h* each have a contact segment 319*a*–319*h* and a compensating segment 321*a*–321*h*. The contact segments 319*a*–319*h* are arranged as in the jack embodiments 100 and 200 of FIGS. 3–9. Each of the compensating segments 321*b*–321*g* includes a traverse, such that none of the compensating segments 321*b*–321*b* is aligned with its respective contact segment 319*b*–319*g*; the contact wires 312*a* and 312*h* are straight, such that the contact segments 319*a*, 319*h* are aligned with their respective compensating segments 321*a*, 321*h*. Compensating segment 321*b* of pair 2 includes an outward traverse that brings the sections 322*a*, 322*b*into vertical alignment; the same is true for sections 322*g* and 322*h* of pair 4. Each of the compensating segments 321*c* and 321*f* of pair 3 includes a relatively larger inward traverse that enables sections 322*c*, 322*f* of these segments to align vertically with each other, and each of the compensating segments 321*d* and 321*e* of pair 1 includes a relatively smaller inward traverse that enables sections 322*d*, 322*e* of these segments to align vertically with each other. Thus, in this embodiment, the sections 322*c*, 322*f* of compensating segments 321*c*, 321*f* of pair 3 align vertically with the sections 322*d*, 322*e* of compensating segments 321*d*, 321*e* of pair 1. However, in this embodiment, the vertically aligned sections 322*a*, 322*b*, 322*g*, 322*h* of the compensating segments of pairs 2 and 4 are not equidistant from a horizontal plane P5 that bisects the compensating segments (see FIG. 11); instead, one section of each of pairs 2 and 4 (sections 322*a*, 322*h*) are positioned generally on the horizontal plane P5, and the other sections of pairs 2 and 4 (sections 322*b*, 322*g*) are positioned on opposite sides of the plane P5 at the approximate elevation of sections 322*c*, 322*f* of pair 3.

In the illustrated embodiment, the stagger distance S6 between the sections 322*g*, 322*h* is 0.09 inch, and the stagger distance S5 between the sections 322*e*, 322*c* is 0.04 inch, although these distances may vary. Also, the transverse distance D4 between the sections 322*g*, 322*h* and the substantially vertically aligned sections 322*c*, 322*e*, 322*d*, 322*f* is 0.14 inch, although this distance may vary.

In this configuration, the differential to differential and differential to common mode crosstalk values can be calculated (under the method described above) and are set forth in Table 6.

TABLE 6

NEAR END CROSSTALK RESULTS FOR WIRE SECTIONS OF FIG. 11

| | A to B DIFF TO DIFF NEXT | | | A to B DIFF TO COM NEXT | | | B to A DIFF TO COM NEXT | | |
|---|---|---|---|---|---|---|---|---|---|
| A to B | XL | XC | TOTAL | XL | XC | TOTAL | XL | XC | TOTAL |
| 1 to 3 | 39.04 | 3.69 | 42.73 | 0 | 0 | 0 | 0 | 0 | 0 |
| 3 to 2 | 7.52 | 0.75 | 8.27 | −3.76 | −0.44 | −4.21 | 1.09 | 0.09 | 1.18 |
| 1 to 2 | 4.74 | 0.59 | 5.33 | −2.37 | −0.29 | −2.66 | 2.05 | 0.24 | 2.29 |

units for all values in mV/V/in.

Note that the pair 1 to 3 differential to differential and differential to common mode remain the same as for the embodiment of FIGS. 8 and 9, but the 3 to 2 differential to common mode now flips polarity relative to the prior art jack described in Table 3 and becomes compensating. The pair 2 to 3 differential to common mode crosstalk also has compensating attributes. The pair 1 to 2 differential to common mode degrades somewhat from the embodiment of FIGS. 8 and 9, but not significantly so. The pair 2 to 1 differential to common mode is compensating. One prominent advantage can be the creation of pair 3 to 2 differential to common mode compensation, with negative polarity to compensate for pair 3 to 2 differential to common mode positive polarity coupling in the plug and/or plug/jack contact region. Similar behavior may be observed in the pair 2 to 3 differential to common mode crosstalk. The ability of this embodiment to provide negative polarity for pair 3 to 2 differential to common mode crosstalk, and/or positive polarity for pair 2 to 3 differential to common mode crosstalk, may lead to improved channel alien NEXT performance using connectors made with this lead frame.

Those skilled in this art will appreciate that the traversing of the compensating sections described above may also be carried out in other ways. For example, if both compensation sections of a pair include traverses to be come substantially vertically aligned, the pair may be configured such that only one of the compensation sections includes a traverse, with the distance of that traverse being equal to the total of the distances of both of the traverses of the pair illustrated herein. Conversely, if a pair includes only a single traverse, that pair may alternatively be configured such that both of the compensation sections include a traverse, with the sum of the traverses of those compensation sections being equal to the distance of the original traverse. Other configurations may also be suitable for use with this invention.

Those skilled in this art will recognize that other jack configurations may also be suitable for use with the present invention. For example, as discussed above, other configurations of jack frames, covers and terminal housings may also be employed with the present invention. As a further example, communications jacks may be employed within a patch panel or series of patch panels.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A communications jack, comprising:

a dielectric mounting substrate; and a plurality of contact wires, each of the contact wires having a contact segment, a compensating segment in electrical connection with the contact segment, and a base in electrical connection with the compensating segment and mounted in the mounting substrate;

wherein the contact segments are generally transversely aligned and parallel with each other, and wherein the contact wires are arranged in pairs, with a first pair of contact wires having contact segments that are immediately adjacent each other, a second pair of contact wires having contact segments that are immediately adjacent each other and positioned on one side of the contact segments of the first pair of contact wires, a fourth pair of contact wires having contact segments that are immediately adjacent each other and positioned on an opposite side of the contact segments of the first pair of contact wires, and a third pair of contact wires having contact segments sandwiching the contact segments of the first pair of contact wires, with one of the contact segments of the third pair of contact wires being disposed between the contact segments of the first and second pairs of contact wires, and the other of the contact segments of the third pair of contact wires being disposed between the contact segments of the first and fourth pairs of contact wires; and wherein sections of the compensation segments of the second pair of contact wires are substantially vertically aligned with each other, and wherein sections of the compensation segments of the fourth pair of contact wires are substantially vertically aligned with each other.

2. The communications jack defined in claim 1, wherein sections of the compensation segments of the first pair of contact wires are substantially vertically aligned.

3. The communications jack defined in claim 2, wherein sections of the compensation segments of the third pair of contact wires are substantially vertically aligned.

4. The communications jack defined in claim 3, wherein the substantially vertically aligned sections of the compensation segments of the third pair of contact wires vertically sandwich the substantially vertically aligned sections of the compensation segments of the first pair of contact wires.

5. The communications jack defined in claim 1, wherein sections of the compensation segments of the third pair of contact wires are substantially vertically aligned.

6. The communications jack defined in claim 1, wherein the substantially vertically aligned sections of the compensation segments of the second pair of contact wires are on opposite sides of and substantially equidistant from a horizontal plane that passes between and equidistant from the compensation segments of the first pair of contact wires, and wherein the substantially vertically aligned sections of the compensation segments of the fourth pair of contact wires are on opposite sides of and substantially equidistant from the horizontal plane.

7. The communications jack defined in claim 1, wherein a horizontal plane passes between and equidistant from substantially vertically aligned sections of the compensation segments of the first pair of contact wires, and wherein the substantially vertically aligned sections of the compensation segments of the second pair of contact wires are not substantially equidistant from the horizontal plane, and wherein the substantially vertically aligned sections of the compensation segments of the fourth pair of contact wires are not substantially equidistant from the horizontal plane.

8. The communications jack defined in claim 1, wherein a vertical plane passes between and equidistant from the contact segments of the first pair of contact wires, and wherein a distance between each of the substantially vertically aligned sections of the compensation segments of the second pair of contact wires and the vertical plane is substantially the same as a distance between each of the substantially vertically aligned sections of the contact segments of the fourth pair of contact wires and the vertical plane.

9. A communications jack, comprising:

a dielectric mounting substrate; and a plurality of contact wires, each of the contact wires having a contact segment, a compensating segment in electrical connection with the contact segment, and a base in electrical connection with the compensating segment and mounted in the mounting substrate;

wherein the contact segments are generally transversely aligned and parallel with each other, and wherein the contact wires are arranged in pairs, with a first pair of contact wires having contact segments that are immediately adjacent each other, a second pair of contact wires having contact segments that are immediately adjacent each other and positioned on one side of the contact segments of the first pair of contact wires, a fourth pair of contact wires having contact segments that are immediately adjacent each other and positioned on an opposite side of the contact segments of the first pair of contact wires, and a third pair of contact wires having contact segments sandwiching the contact segments of the first pair of contact wires, with one of the contact segments of the third pair of contact wires being disposed between the contact segments of the first and second pairs of contact wires, and the other of the contact segments of the third pair of contact wires being disposed between the contact segments of the first and fourth pairs of contact wires; and wherein a section of at least one of the compensation segments of the first pair of contact wires and a section of at least one of the compensation segments of the third pair of contact wires are substantially vertically aligned.

10. The communications jack defined in claim 9, wherein sections of the compensation segments of the third pair of contact wires are substantially vertically aligned.

11. The communications jack defined in claim 9, wherein sections of the compensation segments of the first pair of contact wires are substantially vertically aligned.

12. The communications jack defined in claim 9, wherein sections of the compensation segments of both the first and third pairs of contact wires are substantially vertically aligned, and wherein the substantially vertically aligned sections of the compensation segments of the third pair of contact wires vertically sandwich the substantially vertically aligned sections of the compensation segments of the first pair of contact wires.

13. The communications jack defined in claim 9, wherein sections of the compensation segments of the second pair of contact wires are substantially vertically aligned with each other, and wherein sections of the compensation segments of the fourth pair of contact wires are substantially vertically aligned with each other.

14. The communications jack defined in claim 13, wherein the substantially vertically aligned sections of the compensation segments of the second pair of contact wires are on opposite sides of and substantially equidistant from a horizontal plane that passes between and equidistant from the compensation segments of the first pair of contact wires, and wherein the substantially vertically aligned sections of the compensation segments of the fourth pair of contact wires are on opposite sides of and substantially equidistant from the horizontal plane.

15. The communications jack defined in claim 13, wherein a horizontal plane passes between and equidistant from the compensation segments of the first pair of contact wires, and wherein the substantially vertically aligned sections of the compensation segments of the second pair of contact wires are not substantially equidistant from the horizontal plane, and wherein the substantially vertically aligned sections of the compensation segments of the fourth pair of contact wires are not substantially equidistant from the horizontal plane.

16. A communications jack, comprising:

a dielectric mounting substrate; and a plurality of contact wires, each of the contact wires having a contact segment,a compensating segment in electrical connection with the contact segment, and a base in electrical connection with the compensating segment and mounted in the mounting substrate;

wherein the contact segments are generally transversely aligned and parallel with each other, and wherein the contact wires are arranged in pairs, with a first pair of contact wires having contact segments that are immediately adjacent each other, a second pair of contact wires having contact segments that are immediately adjacent each other and positioned on one side of the contact segments of the first pair of contact wires, a fourth pair of contact wires having contact segments that are immediately adjacent each other and positioned on an opposite side of the contact segments of the first pair of contact wires, and a third pair of contact wires having contact segments sandwiching the contact segments of the first pair of contact wires, with one of the contact segments of the third pair of contact wires being disposed between the contact segments of the first and second pairs of contact wires, and the other of the contact segments of the third pair of contact wires being disposed between the contact segments of the first and fourth pairs of contact wires;

wherein at least one of the contact wires on at least two of the pairs of contact wires include a traverse between the contact segment and the compensating segment; and wherein the compensating segments are configured and arranged such that differential to common mode crosstalk from the contact segments of the third pair of contact wires onto the compensating segments of the second pair of contact wires is opposite in polarity to the differential to common mode crosstalk from the compensating segments of the third pair of contact wires onto the compensating segments of the second pair of contact wires.

17. The communications jack defined in claim 16, wherein sections of the compensation segments of the second pair of contact wires are substantially vertically aligned with each other, and wherein sections of the compensation segments of the fourth pair of contact wires are substantially vertically aligned with each other.

18. The communications jack defined in claim 16, wherein sections of the compensation segments of the first pair of contact wires are substantially vertically aligned.

19. The communications jack defined in claim 18, wherein sections of the compensation segments of the third pair of contact wires are substantially vertically aligned.

20. The communications jack defined in claim 19, wherein the substantially vertically aligned sections of the compensation segments of the third pair of contact wires vertically sandwich the substantially vertically aligned sections of the compensation segments of the first pair of contact wires.

21. The communications jack defined in claim 16, wherein sections of the compensation segments of the third pair of contact wires are substantially vertically aligned.

22. The communications jack defined in claim 16, wherein a horizontal plane passes between and equidistant from the compensation segments of the first pair of contact wires, and wherein the compensation segments of the second pair of contact wires are not substantially equidistant from the horizontal plane, and wherein the compensation segments of the fourth pair of contact wires are not substantially equidistant from the horizontal plane.

* * * * *